US005156296A

United States Patent [19]

Vasquez

[11] Patent Number: 5,156,296

[45] Date of Patent: Oct. 20, 1992

[54] MULTI-COMPARTMENT CONTAINER APPARATUS

[76] Inventor: Joe C. Vasquez, 76 N. 25th St., San Jose, Calif. 95116

[21] Appl. No.: 817,326

[22] Filed: Jan. 6, 1992

[51] Int. Cl.[5] ..... B65F 3/14

[52] U.S. Cl. ..... 220/524; 100/223; 100/283; 100/288; 220/909; 220/254

[58] Field of Search ..... 100/288, 283, 223; 220/523, 524, 23.4, 23.83, 23.86, 909, 526, 908, 254

[56] References Cited

U.S. PATENT DOCUMENTS

| | | | |
|---|---|---|---|
| 2,695,238 | 11/1954 | Ferguson | 220/526 |
| 3,531,909 | 10/1970 | Edelbalk | 100/288 |
| 3,648,875 | 3/1972 | Lundgren | 220/404 |
| 3,904,218 | 9/1975 | Kostic | 220/909 |
| 4,834,253 | 5/1989 | Crine | 220/909 |
| 4,874,111 | 10/1989 | Heller | 220/909 |
| 4,955,503 | 9/1990 | Propes | 220/526 |
| 5,046,635 | 9/1991 | Haas et al. | 220/909 |
| 5,062,540 | 11/1991 | Jenkins | 220/909 |

FOREIGN PATENT DOCUMENTS

| | | | |
|---|---|---|---|
| 2166391 | 2/1974 | Fed. Rep. of Germany | 100/223 |
| 2816049 | 10/1979 | Fed. Rep. of Germany | 100/223 |
| 3332742 | 3/1985 | Fed. Rep. of Germany | 220/909 |
| 3531554 | 3/1987 | Fed. Rep. of Germany | 220/909 |
| 3642734 | 6/1988 | Fed. Rep. of Germany | 220/909 |
| 2017646 | 10/1979 | United Kingdom | 220/523 |

*Primary Examiner*—Stephen Marcus
*Assistant Examiner*—S. Castellano
*Attorney, Agent, or Firm*—Leon Gilden

[57] ABSTRACT

A container apparatus includes a container housing divided into a multiplicity of chambers by intersecting webs, with the lid including spaced parallel ribs for securement to an upper distal end of each of the webs, wherein the lid includes flap members arranged hingedly relative to the lid for selective access to each of said chambers. A compacting apparatus is arranged in association with the container apparatus to effect compacting of discrete components within individual chambers of the container structure.

3 Claims, 4 Drawing Sheets

MULTI-COMPARTMENT CONTAINER APPARATUS

BACKGROUND OF THE INVENTION

1. Field of the Invention

The field of invention relates to container apparatus, and more particularly pertains to a new and improved multi-compartment container apparatus wherein the same is arranged to divide a container into various chambers for selective disposal of discrete categories of refuse.

2. Description of the Prior Art

Multi-compartment container apparatus of various types have been utilized in the prior art for the disposition of various categories within the chambers. Such apparatus is exemplified in the U.S. Pat. No. 4,801,034 to Sandomeno; U.S. Pat. No. 4,821,903 to Hayes; U.S. Pat. No. 3,720,346 to Cypher; U.S. Pat. No. 3,893,615 to Johnson; and U.S. Pat. No. 4,874,111 to Heller.

Accordingly, it may be appreciated that there continues to be a need for a new and improved multi-compartment container apparatus as set forth by the instant invention which addresses both the problems of ease of use as well as effectiveness in construction in providing a multi-compartmented container arranged for the disposition of various categories of components within respective chambers of the container, as well as associated compacting apparatus in selective cooperation with selective ones of the chambers.

SUMMARY OF THE INVENTION

In view of the foregoing disadvantages inherent in the known types of multi-compartment container apparatus now present in the prior art, the present invention provides a multi-compartment container apparatus wherein the same is directed to the collection of various categories of refuse components and their separation in association with compacting apparatus. As such, the general purpose of the present invention, which will be described subsequently in greater detail, is to provide a new and improved multi-compartment container apparatus which has all the advantages of the prior art multi-compartment container apparatus and none of the disadvantages.

To attain this, the present invention provides a container apparatus including a container housing divided into a multiplicity of chambers by intersecting webs, with the lid including spaced parallel ribs for securement to an upper distal end of each of the webs, wherein the lid includes flap members arranged hingedly relative to the lid for selective access to each of said chambers. A compacting apparatus is arranged in association with the container apparatus to effect compacting of discrete components within individual chambers of the container structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-compartment container apparatus which has all the advantages of the prior art multi-compartment container apparatus and none of the disadvantages.

It is another object of the present invention to provide a new and improved multi-compartment container apparatus which may be easily and efficiently manufactured and marketed.

It is a further object of the present invention to provide a new and improved multi-compartment container apparatus which is of a durable and reliable construction.

An even further object of the present invention is to provide a new and improved multi-compartment container apparatus which is susceptible of a low cost of manufacture with regard to both materials and labor, and which accordingly is then susceptible of low prices of sale to the consuming public, thereby making such multi-compartment container apparatus economically available to the buying public.

Still yet another object of the present invention is to provide a new and improved multi-compartment container apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularily in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
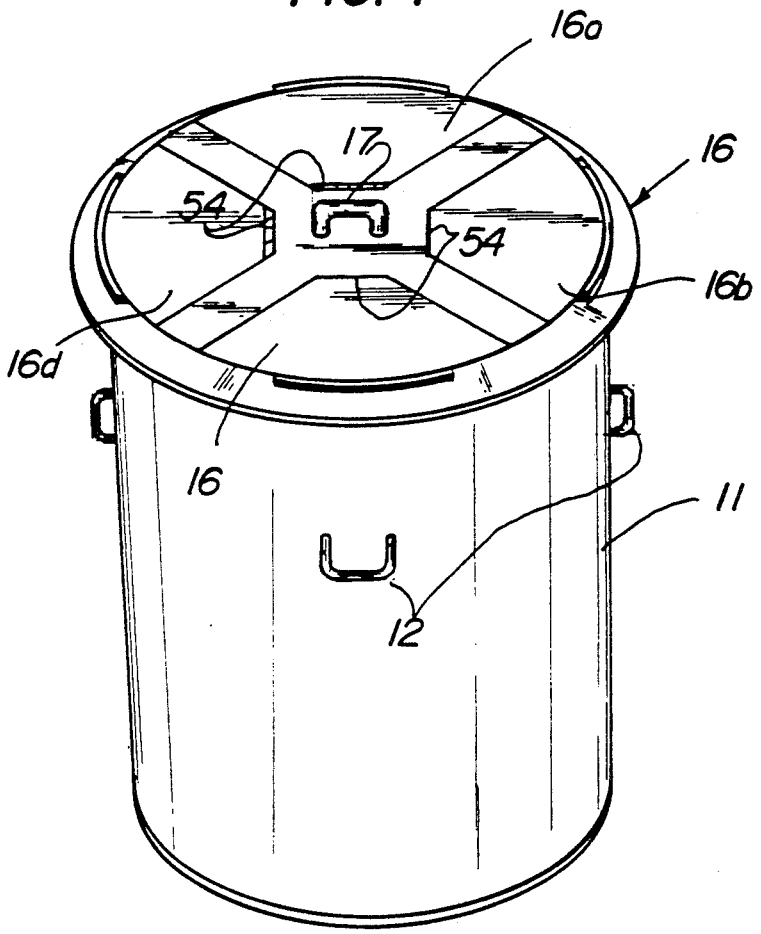
FIG. 1 is an isometric illustration of the container of the instant invention.
Figure 2:
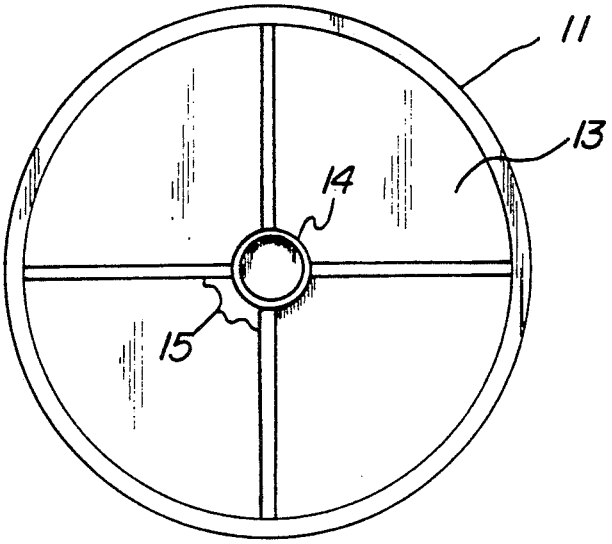
FIG. 2 is an orthographic bottom view of the container.
Figure 3:
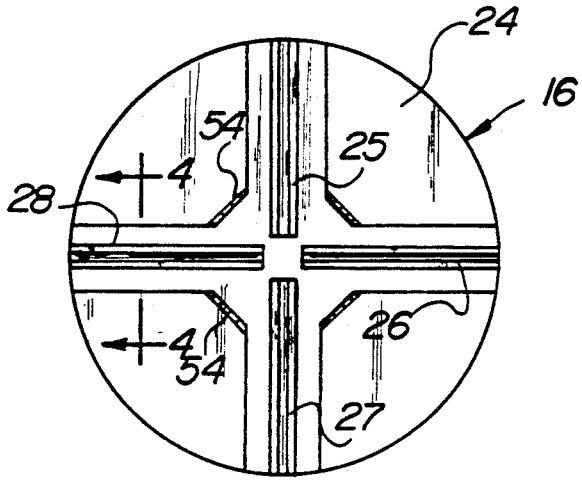
FIG. 3 is an orthographic bottom view of the lid structure utilized by the invention.
Figure 4:
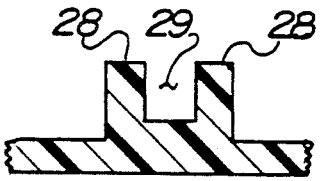
FIG. 4 is an orthographic view, taken along the lines 4—4 of FIG. 3 in the direction indicated by the arrows.
Figure 5:
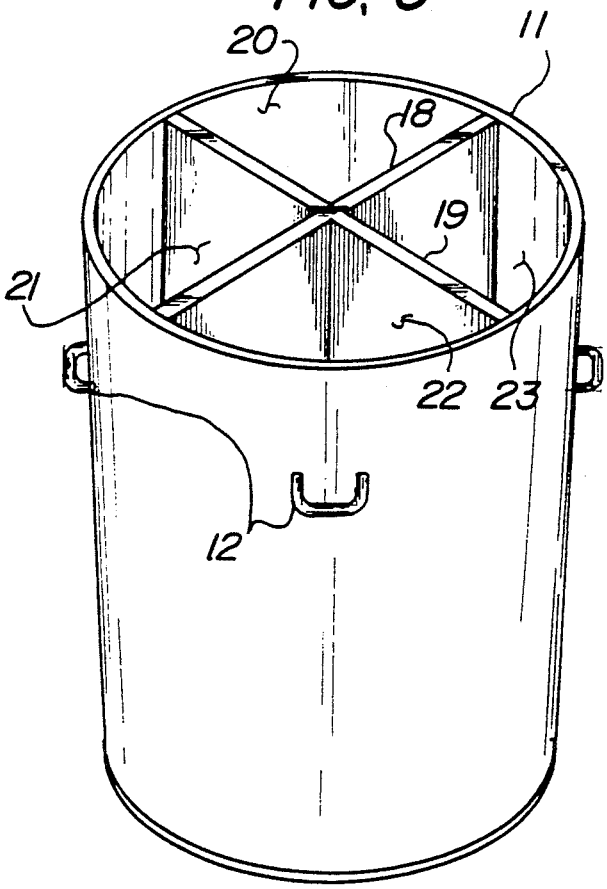
FIG. 5 is an isometric illustration of the container with the lid removed therefrom.

With reference now to the drawings, and in particular to FIGS. 1 to 7 thereof, a new and improved multi-compartment container apparatus embodying the principles and concepts of the present invention and generally designated by the reference numerals 11 through 54 will be described.

More specifically, the multi-compartment container apparatus of the instant invention essentially comprises a cylindrical container 11 to include side wall handles 12 mounted to the side wall of the container that are spaced apart ninety degrees relative to one another for ease of manipulation of the container. The container includes a container bottom wall 13 that is formed with a central hub 14 coaxially aligned and orthogonally directed relative to the bottom wall 13, including radial ribs 15 directed from the central hub 14 to the periphery of the bottom wall as the ribs are spaced apart ninety degrees. A lid 16 is arranged for mounting to an upper distal end of the container 11, wherein the lid 16 includes a lid handle 17 mounted coaxially to a top surface of the lid 16. The lid is formed with respective first, second, third, and fourth respective lid flaps 16*a*, 16*b*, 16*c*, and 16*d*, each hingedly mounted about a lid hinge 54 within the lid 16. The bottom surface of the lid includes respective first, second, third, and fourth pairs of guide ribs 25, 26, 27, and 28, each spaced apart to define a web receiving slot 29 to receive an upper distal end of intersecting first and second webs 18 and 19 (see FIG. 5). The first and second webs 18 and 19 are orthogonally directed relative to one another within the container 11, each diametrically bisecting the container to divide the container into respective first, second, third, and fourth chambers 20, 21, 22, and 23 for the reception of various categories of refuse therewithin.

The container accordingly is arranged for the reception of the various refuse of recycling components, wherein the lid flaps 16*a*–16*d* permit selective access to the various chambers 20–24.

Figure 6:
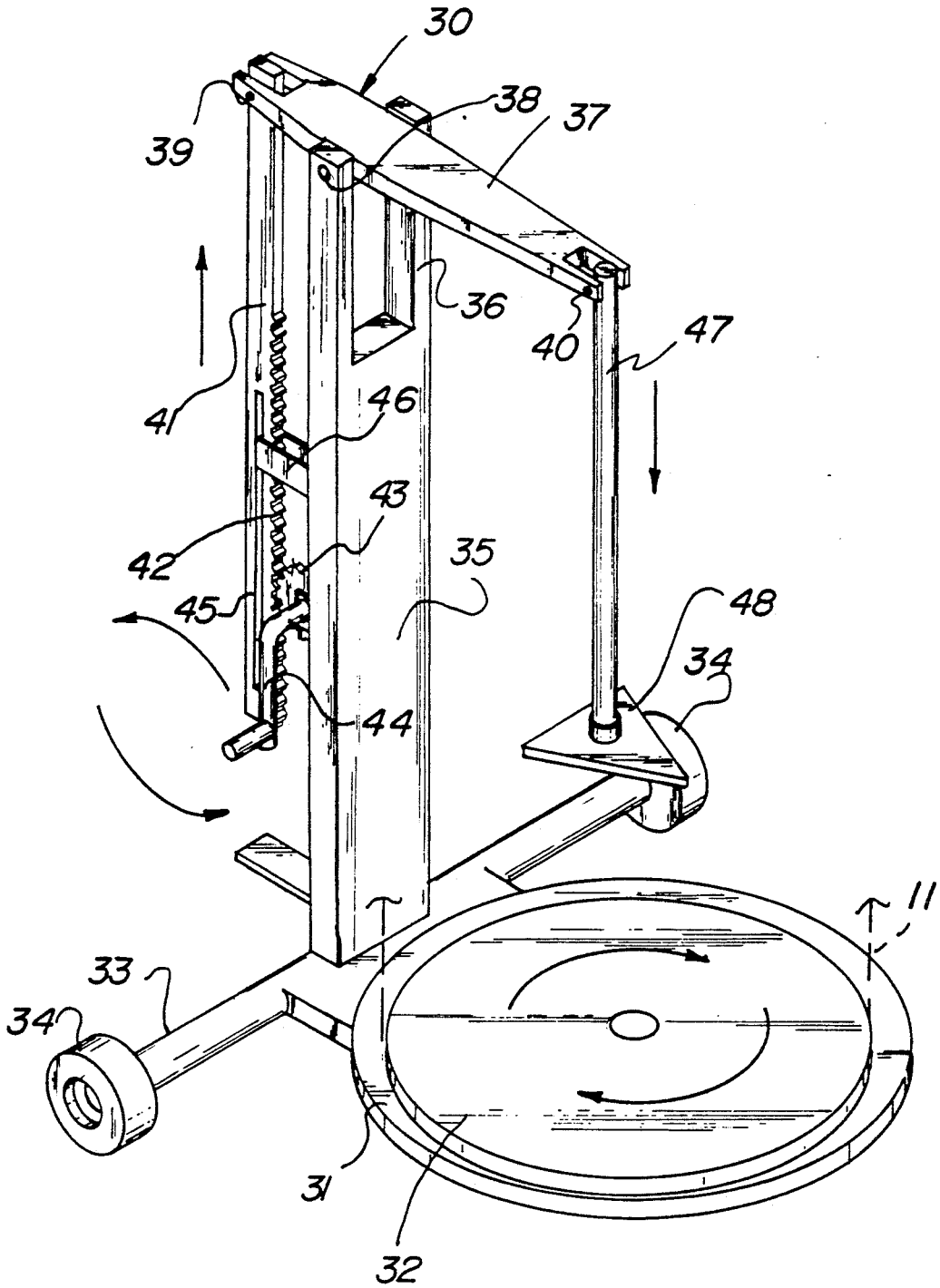
FIG. 6 is an isometric illustration of the compacting structure utilized by the invention.
Figure 7:
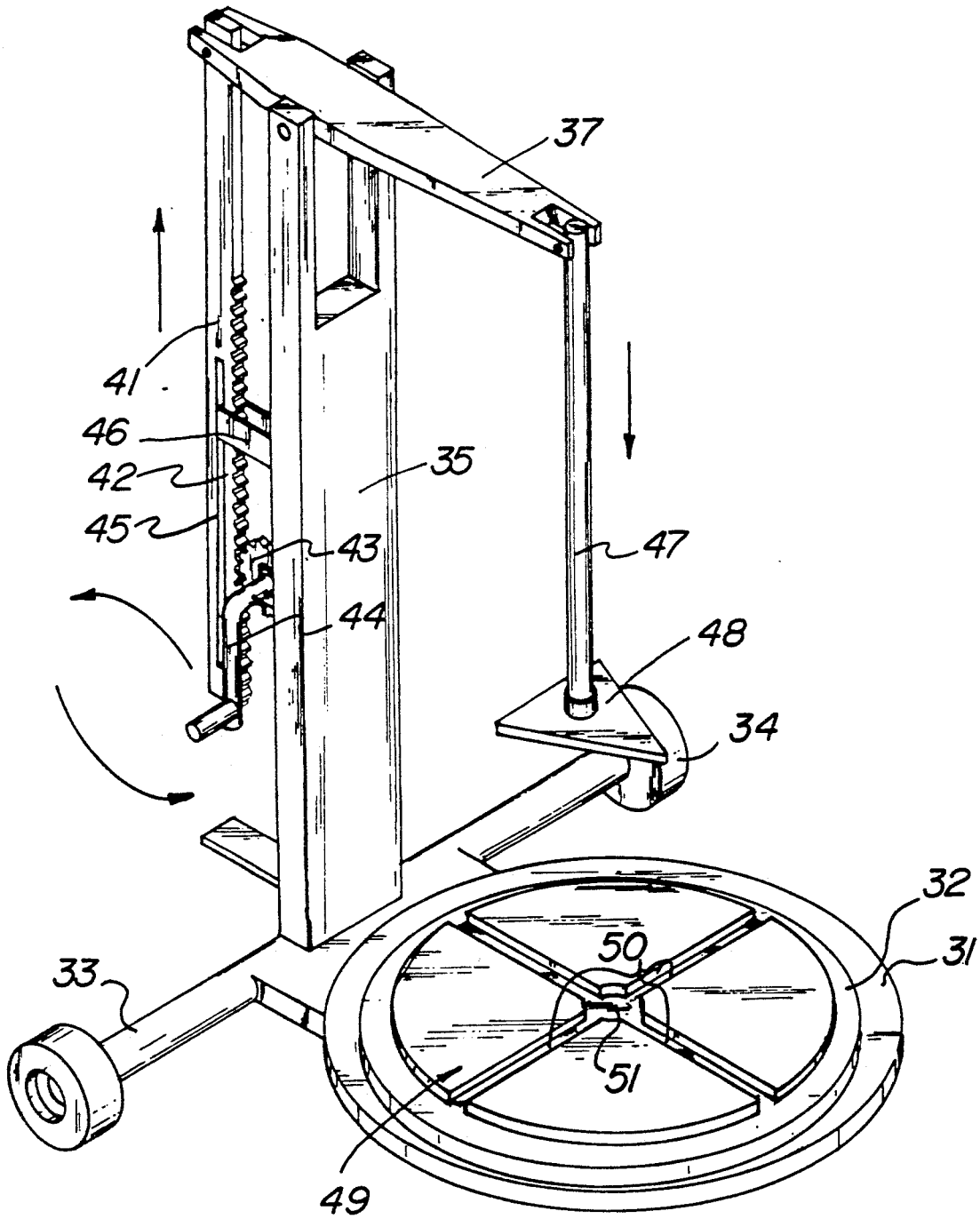
FIG. 7 is an isometric illustration of the compacting structure utilizing a magnetically adherable lowermost positioning disc.

The apparatus includes a compactor assembly 30 arranged for mounting the container upon a rotary support plate 32 that is rotatably mounted to a fixed base plate 31 positioned below the rotary support plate 32. A support axle 33 is arranged coplanar with the base plate 31, with the base plate 31 medially and fixedly secured to the support axle 33, with a wheel member 34 mounted at each distal end of the support axle 33 for permitting rotation of the compactor assembly 30. A support post 35 is orthogonally and fixedly mounted to the base plate 31 extending upwardly thereof terminating in a bifurcated upper end 36. A lever plate 37 is pivotally mounted within the bifurcated upper end 37 to include a lever plate first axle 38 directed through the bifurcated upper end to pivotally mount the lever plate relative to the upper end 36. A lever plate second axle 39 directed through a bifurcated rear distal end of the lever plate 37 has pivotally mounted thereto an actuator link 41. A lever plate third axle 40 mounted to a bifurcated forward distal end of the lever plate 37 pivotally mounts a compressor rod 47. The actuator link 41 includes a gear rack 42 that is cooperate with a rotary gear 43 mounted to the support post 35. A gear handle 44 permits rotation of the gear 43 for effective reciprocation of the gear rack and pivotment of the lever plate 37 accordingly, in a manner as illustrated in FIG. 6. An actuator link slot 45 is directed through the actuator link 41 to receive a guide bracket 46 to slidingly guide the gear rack 41 in a parallel relationship rearwardly of the support post 35. The compressor rod includes a foot plate 48 mounted at a lower distal end thereof for reception into one of the first through fourth chambers 20–23, whereupon lifting of an associated flap 16*a*–16*d* permits access to an associated chamber permits compacting of the chamber when the container 11 is mounted upon the support plate 32. Alternatively, the support plate may be provided with a ferromagnetic positioning disc 49 that includes orthogonally intersecting slots 50 diametrically directed through the positioning disc 49 to include an axial recess 51 medially thereof. In this manner, the ferromagnetic positioning disc 49 is adherably attracted to the ferrous container bottom wall 13 to receive the radial ribs 15 and the central hub 14 within the associated slots 50 and recess 51 of the ferromagnetic positioning disc 49 to effectively align and position the container in proper alignment relative to the compressor rod an its associated foot plate 48.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-compartment container apparatus, comprising, a cylindrical container to include a side wall, with the side wall including a plurality of handles, the handles fixedly mounted to the side walls spaced ninety degrees apart relative to one another, and the container including a container bottom wall, the container bottom wall including a central hub coaxially aligned orthogonally through the bottom wall relative to the container, and radial ribs directed from the central hub to the container side wall, with the ribs spaced ninety degrees relative to one another and fixedly mounted to the bottom wall, and a lid securable to an upper distal end of the cylindrical container, wherein the lid includes a lid handle medially to a top surface of the lid, the lid including a first lid flap, a second lid flap, a third lid flap, and a fourth lid flap, each lid flap hingedly mounted relative to the lid, and the lid including a respective pair of guide ribs positioned between the first lid flap and the second lid flap, a second pair of guide ribs positioned between the second lid flap and the third lid flap, a third pair of guide ribs positioned between the third lid flap and the fourth lid flap, and a fourth pair of guide ribs positioned between the fourth lid flap and the first lid flap, wherein the guide ribs are spaced apart ninety degrees relative to one another and each pair of guide ribs define a receiving slot therebetween, and a first web diametrically directed through the container interiorly thereof orthogonally intersecting a second web, wherein the second web is diametrically arranged to bisect the container interiorly of the container, the first web and the second web defines a first chamber, a second chamber, a third chamber, and a fourth chamber, the chambers positioned between the webs and the container side wall interiorly of the container, with each pair of guide ribs of said guide ribs arranged for securement to an upper distal end of one of said webs, and a compactor assembly, the compactor assembly including a base plate, the base plate including a rotary support plate, and the container mounted securedly relative to the rotary support plate, and a support axle mounted to the base plate spaced from the rotary support plate, the support axle including a well member mounted at each distal end of the support axle, and a support post orthogonally and integrally mounted to the base plate extending upwardly thereof, the support post including a lever plate mounted to an upper distal end of the support post, and a first axle directed through the lever plate and the upper distal end of the support post to pivotally mount the lever plate relative to the support post, and a second axle mounted to a rear distal end of the lever plate, the second axle pivotally secured to drive means for effecting pivotment of the lever plate relative to the support post, and a forward distal end of the support post including a third axle, the third axle pivotally mounted to a compressor rod, and a lower distal end of the compressor rod including a foot plate, the foot plate selectively received within one of said chambers of said first, second, third, and fourth chambers.

2. An apparatus as set forth in claim 1 wherein the drive means includes a rotary gear mounted to the support post, and the second axle pivotally mounted to an actuator link, the actuator link including a gear rack, the gear rack in operative communication with the rotary gear, and the actuator link including an actuator link slot directed longitudinally of the actuator link, and a guide bracket mounted to the support post and slidably received through the actuator link slot to position the actuator link in a spaced parallel relationship relative to the support post.

3. An apparatus as set forth in claim 2 wherein the rotary support plate includes a ferromagnetic positioning disc, the ferromagnetic positioning disc includes orthogonally intersecting slots diametrically directed through the positioning disc, the positioning disc fixedly mounted to the rotary support plate, and the cylindrical container bottom wall formed of a ferrous material, with the radial ribs received within the positioning disc slots, and the positioning disc including an axial recess of the positioning disc to receive the central hub of the container bottom wall therewithin.

* * * * *